United States Patent [19]

Sato et al.

[11] Patent Number: 4,686,413

[45] Date of Patent: Aug. 11, 1987

[54] CATHODE FOR MAGNETRON

[75] Inventors: Yoshihiko Sato, Kunitachi; Nobuaki Yamamoto, Musashimurayama, both of Japan

[73] Assignee: New Japan Radio Co., Ltd., Tokyo, Japan

[21] Appl. No.: 942,955

[22] Filed: Dec. 17, 1986

Related U.S. Application Data

[60] Division of Ser. No. 910,262, Sep. 16, 1986, abandoned, which is a continuation of Ser. No. 823,866, Jan. 29, 1986, abandoned.

[30] Foreign Application Priority Data

Feb. 6, 1985 [JP] Japan ..... 60-21379

[51] Int. Cl.[4] ..... H01J 1/13; H01J 25/50

[52] U.S. Cl. ..... 313/346 R; 313/337; 313/338; 315/39.51

[58] Field of Search ..... 313/346 R, 337, 338; 315/39.51

[56] References Cited

U.S. PATENT DOCUMENTS

| | | | |
|---|---|---|---|
| 2,782,334 | 2/1957 | Gardner | 313/338 |
| 2,832,005 | 4/1958 | Brown | 313/338 |
| 3,278,791 | 10/1966 | Faure | 313/338 |
| 3,585,438 | 6/1971 | Bell | 313/338 |
| 4,230,005 | 10/1980 | Oguro | 315/39.51 |
| 4,380,717 | 4/1983 | Pickering | 315/39.51 |
| 4,524,297 | 6/1985 | Gärtner | 313/346 R |

*Primary Examiner*—Arthur P. Demers

*Attorney, Agent, or Firm*—Armstrong, Nikaido, Marmelstein & Kubovcik

[57] ABSTRACT

A method of manufacturing a cathode for magnetron comprises a cathode sleeve formed as a hollow cylinder, a heater inside the sleeve, two end shields formed around the sleeve at a prescribed interval and an electron emitting material applied around the sleeve between both end-shields, wherein a plurality of isolated projections are almost regularly and intergraly formed around the sleeve between the end-shields, and the above electron emitting material is applied onto the cathode sleeve to fill gaps among the plural projections.

According to the method of manufacturing a cathode of the present invention, the efficiency of electron emission and electric conductivity are not lowered, whereby the stable operation can be realized for a long term.

7 Claims, 8 Drawing Figures

CATHODE FOR MAGNETRON

This application is a division of application Ser. No. 910,262 filed Sept. 19, 1986, now abandoned, (which is a continuation of Ser. No. 823,866, filed Jan. 29, 1986) now abandoned.

BACKGROUND OF THE INVENTION

The present invention relates to a method of manufacturing a cathode for a magnetron which has an extended life and has a low cost to manufacture.

Hitherto, there is coated a powdery electron emitting material composed of an oxide of barium, strontium, calcium, or the like onto a cathode of magnetron so that sufficient electron can be emitted from the material so that sufficient electron can be emitted from the material by heating the cathode with a heater. The electron emitting material is partly evaporated due to thehigh temperature of cathode during an operation, and also is damaged and eroded because a part of the electron emitted from the electron emitting material returns to the surface of the electron emitting material as back bombardment under the influence of the applied magnetic field.

Furthermore, a magnetron is usually operated with a pulse current whereby a large peak-current flows. In this case, there occurs a local spark or arc due to low electrical conductivity of the electron emitting material and the electron emitting material is also damaged.

In order to improve the above-mentioned drawbacks, cathodes of which construction are shown in FIG. 7 and 8 are proposed so as to lower thedamage or erosion of the electron emitting material. In FIG. 7, numeral 1 is a heater composed of tungsten, or the like, and numeral 2 is a hollow cylindrical cathode sleeve composed of nickel, an alloy thereof, or the like. The heater 1 is contained in the sleeve 2. On the sleeve 2, end-shields 3 and 4 are provided at such interval that corresponds to the width of a vane (anode). The outer surface of the sleeve 2 between the end-shields 3 and 4 is coated with a mixed electron emitting material 5 obtained by mixing a metal powder with the above-mentioned electron emitting material. In this embodiment, the metal powder lowers the effective resistance of the electron emitting material and protects the electron emitting material against the electron back bombardment.

However, in the arrangement of FIG. 7, when the cathode is used for a long term, the electron emitting material in the above-mentioned mixture 5 decreases and becomes thin by erosion or evaporation, and then the surface of the above-mentioned mixture 5 becomes rich in metal. Accordingly, there is generated a problem that the efficiency of electron emission, is lowered since the secondary electron, emission caused by a back bombardment of the emitted electron is reduced.

In the arrangement of FIG. 8, the outer surface of the sleeve 2 between the end-shields 3 and 4 is covered with a metal mesh 6 which is welded onto the outer surface of the sleeve, and an electron emitting material 7 is applied onto the surface so that the meshes of the metal mesh 6 are filled with the electron emitting material 7. In this embodiment, the metal mesh 6 functions as the above-mentioned metal powder.

In the arrangement of FIG. 8, however, the metal mesh 6 is easily peeled off from the surface of the sleeve 2 due to thermal-stress caused by the repetition of on-off action of a magnetron. In such a case, the electric resistance is increased and the electron emitting material 7 is badly damaged, and there are caused various troubles due to the increase of thermal resisance.

Further, in order to improve the above drawback due to the peeling off of the metal mesh from the cathode sleeve and thereby to improve the reliability of a magnetron, there is proposed a magnetron wherein metal walls defining recesses are formed integrally with a cathode sleeve as in disclosed in U.S. Pat. No. 4,380,717. However, the principal consideration of the above prior art is to make the metal walls defining recesses substantially parallel (or to make the recesses to be undercut portions). Also, there is a large labor cost to manufacture a cathode sleeve having the above mentioned shape, whereby raising the cost of manufacturing a cathode, i.e. a magnetron. Further, since the metal walls are made substantially parallel, electron emissive material is hard to deposite downward due to its shrinkage or sinter caused by the rise in temperature of a cathode, whereby voids are apt to generate within electron emissive material. In result, there are caused the same problems as in the example shown in FIG. 8 that electric resistance increases and the temperature of electron emissive material unusually rises.

It is an object of the present invention to provide a method of manufacturing a cathode for magnetron wherein such a problem as generation of voids within electron emissive material do not take place ever if the cathode is elevated in temperature; manufacturing processes are easy; and the manufacturing cost is low.

This and other objects of the invention will become apparent from the description hereinafter.

SUMMARY OF THE INVENTION

The present invention is concerned with a method of manufacturing a cathode for magnetron wherein a plurality of isolated projections are integrally formed at regular intervals on the surface of the cathode sleeve between end-shields, and the gaps among the above projections are filled with the above-mentioned electron emitting material.

DETAILED DESCRIPTION

Figure 1:
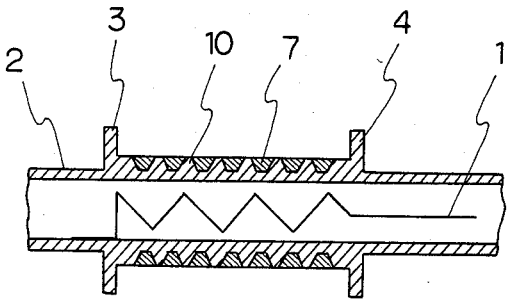
FIG. 1 is a sectional view of an embodiment of a cathode for magnetron manufactured in accordance with a method of the present invention.
Figure 2:
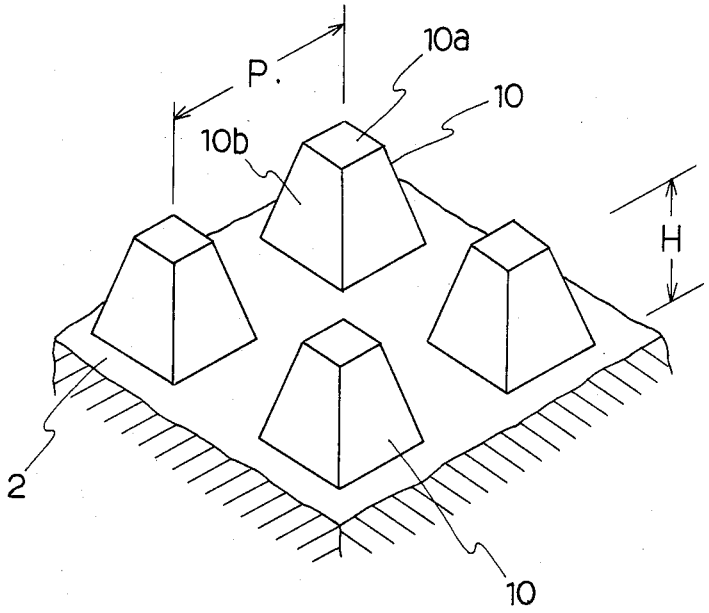
FIG. 2 is a partialy extended enlarged view of the sleeve in FIG. 1.
Figure 7:
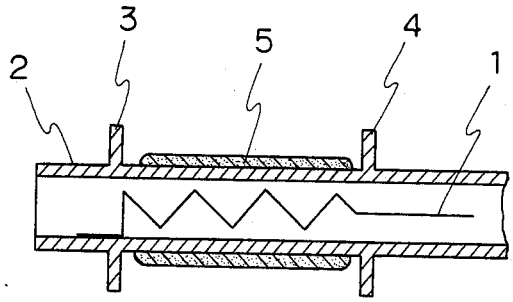
FIGS. 7 and 8 are sectional views of the conventional cathodes for magnetron.
Figure 8:
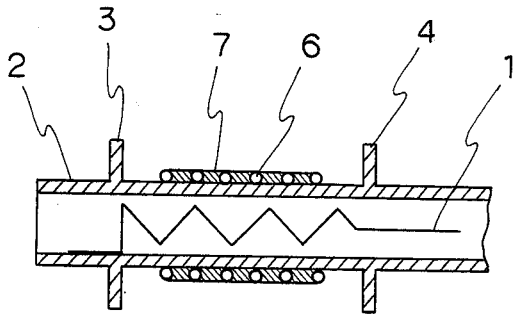

FIG. 1 is an embodiment of cathode manufactured in accordance with a method of the present invention. The same reference numerals as in FIGS. 7 and 8 indicate the same members. In the instant embodiment, a plurality of truncated pyramids 10 are integrally formed at regular intervals as isolated projections on the surface of the sleeve 2 between endshields 3 and 4. The gaps among the truncated pyramids 10 are coated and filled with an electron emitting material 7. The gaps are so filled that the surface of the material reaches the same level as that of an upper base 10*a* (in FIG. 2) of the truncated pyramids 10, and that the upper base 10*a* slightly appears on the surface of the material 7. The height H of the truncated pyramid 10 is, for example, 0.2 to 0.6 mm and the pitch P, i.e. an interval between each other, is 0.4 to 0.8 mm for example.

The sleeve 2 having truncated pyramid 10 is formed, for instance, by cold forging method (compression molding) using a double-cut knurling tool (roulette engraver). In case of employing this method, a solid nickel rod is prepared as a material of the sleeve. The rod is cut using a lathe so that the portion whereat the truncated pyramids 10 are formed has a prescribed diameter. The truncated pyramids 10 are formed by double-cutting the cut portion of the rod with a knurling tool. The rod isi also cut to form end-shields 3 and 4 and is hollowed out to form a hollow portion into which a heater 1 is inserted. The present method allows isolated projection to be formed with great ease and without generating rods within the electron emissive material since it is deposited downward due to the tapered shape of the walls even when it sinters.

The truncated pyramids 10 are formed in accordance with the above-mentioned process and the gaps among the truncated pyramids are filled with the electron emitting material 7. In this arrangement, the truncated pyramids are not peeled off since the truncated pyramids and the sleeve are integrally formed, and accordingly, effective electric resistance and thermal resistance do not increase.

Figure 3:
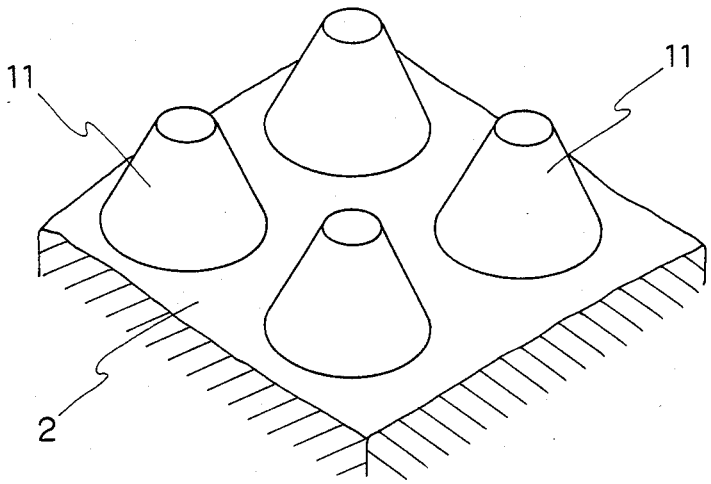
FIGS. 3 to 5 are partially extended enlarged views of sleeves whereon other types of projection are formed.

FIG. 3 shows a plurality of truncated cones 11 which are integrally and regularly formed on a sleeve 2 as isolated projections. In the cathode shown in FIG. 3, the same effect as that obtained in the above prismoid 10 can be obtained. The truncated cones 11 can be formed by a knurling tool in the same manner as in the above case.

Figure 4:
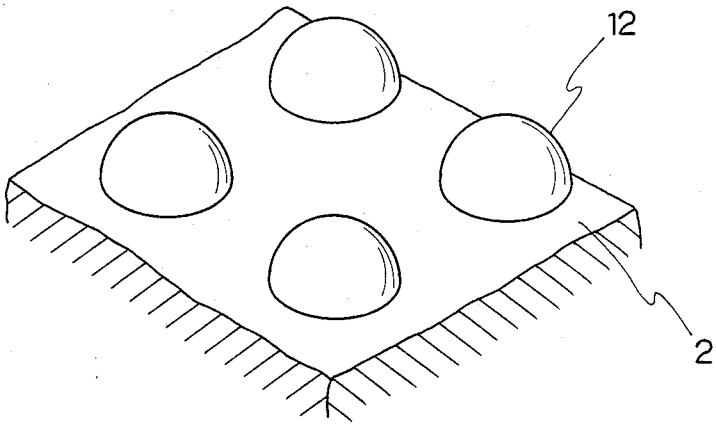
Figure 5:
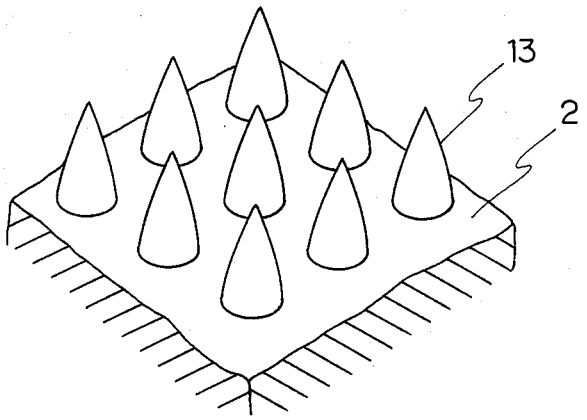
Figure 6:
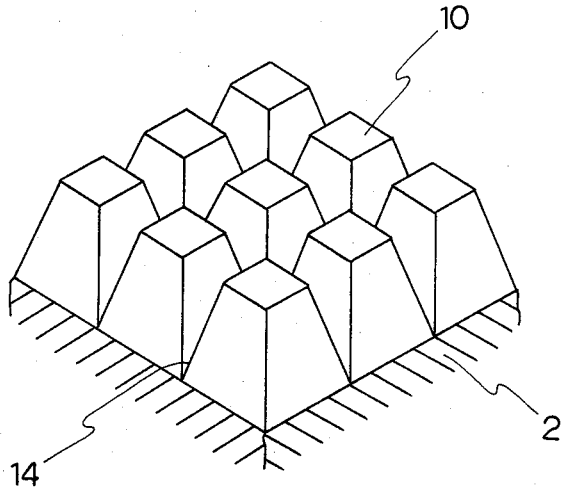
FIG. 6 is a partially extended enlarged view of the sleeve whereon projections comprising modified truncated pyramids are formed.

FIG. 4 shows a plurality of hemispheres 12 which are integrally and regularly formed on a sleeve 2 as isolated projections, and FIG. 5 shows sharpened circular cones 13 which are integrally and regularly formed on a sleeve 2. In both cases, the same effect can be obtained as in the truncated pyramid shown in FIG. 2. In addition to the isolated projections aforementioned, a prism, a column, or the like can be employed. The truncated pyramid 10 or any other shapes of projections can be cut to form a channel 14 instead of forming the plane portion between the projections.

According to the cathode for magnetron of the present invention, the efficiency of electron emission and electric conductivity is not lowered whereby the stable operation can be realized for a long term. For example, in a magnetron having properties of 9 GHz in operation frequency, of 5 to 10 kW in peak output power range and 5 to 10 W in average output power, 2,000 hours of life time is obtained with the cathode shown in FIG. 7 or FIG. 8. However, in the same type of magnetron with the cathode described in the present invention, the life time is extended to 7,000 hours or more.

What we claim is:

1. A method of manufacturing a cathode for a magnetron comprising the steps in sequence of:

(a) preparing a solid nickel rod to form a cathode sleeve, (b) cutting the rod so that the outer shape of a portion whereat a plurality of isolated projections are formed has a prescribed diameter, (c) forming a plurality of isolated projection by cutting the cut portion of the rod with a knurling tool, (d) hollowing out the center of the rod to form a hollow portion into which a heater is inserted, and (e) filling electron emissive material within gaps among the plural projections.

2. The method of claim 1, wherein said isolated projections are truncated pyramids.

3. The method of claim 2, wherein said isolated projections are truncated cones.

4. The method of claim 1, wherein said isolated are hemispheres.

5. The method of claim 1, wherein said isolated are sharpened circular cones.

6. The method of claim 1, wherein said isolated are prisms.

7. The method of claim 1, wherein said isolated are columns.

* * * * *